US005647821A

United States Patent [19]

Johnston

[11] Patent Number: 5,647,821

[45] **Date of Patent: *Jul. 15, 1997**

[54] STATIONARY EXERCISE APPARATUS

[76] Inventor: Gary Lawrence Johnston, P.O. Box 183, Cowarts, Ala. 36321

[ * ] Notice: The term of this patent shall not extend beyond the expiration date of Pat. No. 5,403,255.

[21] Appl. No.: 385,646

[22] Filed: Feb. 8, 1995

Related U.S. Application Data

[63] Continuation-in-part of Ser. No. 970,168, Nov. 2, 1992, Pat. No. 5,403,255, and Ser. No. 136,102, Oct. 13, 1993, Pat. No. 5,387,167.

[51] Int. Cl.[6] ..... A63B 21/00

[52] U.S. Cl. ..... 482/57; 482/51

[58] Field of Search ..... 482/51, 57, 148; 601/23, 27, 34, 35, 36

[56] References Cited

U.S. PATENT DOCUMENTS

| | | | |
|---|---|---|---|
| 4,643,419 | 2/1987 | Hyde | 482/57 |
| 4,779,863 | 10/1988 | Yang | 482/57 |
| 4,786,050 | 11/1988 | Geschwender | 482/57 |
| 4,838,547 | 6/1989 | Sterling | 482/57 |
| 4,915,374 | 4/1990 | Watkins | 482/57 |
| 5,403,255 | 4/1995 | Johnston | 482/57 |

*Primary Examiner*—Stephen R. Crow

[57] ABSTRACT

A stationary exercise apparatus including a frame structure means and a foot engagement means whereby the feet of the user remain in a substantially horizontal position as the foot engaging members of the foot engagement means move along their path of rotation. This allows the user to perform a cycling routine while in a standing position and maintain proper balance. Included may be a resistance means for use during manual operation of the foot engagement means, a motor means for use during automatic operation of the foot engagement means, and an upper body workout means which allows the user to exercise upper body muscles as well as lower body muscles.

14 Claims, 12 Drawing Sheets

STATIONARY EXERCISE APPARATUS

CROSS REFERENCE TO RELATED APPLICATIONS

This application is a Continuation-In-Part of U.S. application Ser. No. 07/970,168 filed Nov. 2, 1992, now U.S. Pat. No. 5,403,255 and U.S. application Ser. No. 08/136,102, filed Oct. 13, 1993 now U.S. Pat. No. 5,387,167.

BACKGROUND OF THE INVENTION

This invention relates to a lower body exercise device and in particular to a stationary device which has an upright structure which allows the user to perform pedaling routines while in a standing position. This features allows for a more overall lower body workout than provided by more conventional stationary lower body exercise devices such as cycles, treadmills, stair-stepper devices, and skiing or glider devices.

As may be seen, there already exists many variations of stationary upright lower body exercise devices. While these units offer a relatively good exercise, they all appear to be one dimensional. Most current cycling devices utilize a seat means, and those that do allow for pedaling in a standing position are not very easy to operate due to difficulties with the user keeping good balance. Current stair-stepper exercise devices and glider or skiing devices allow for very little rotary motion in the hip and stomach area. The stair-steppers allow for upward and downward motion in the user while glider or skiing devices allow for backward and forward motion in the user. Treadmills do provide for rotary motion in the hips and stomach, but forces act against the user only as the user steps on treadmill base. This new exercise device provides a force against the user during upward, downward, backward, and forward leg motion, and therefore much more rotary motion in the hip and stomach area. Given the fact that there are a vast number of exercise devices, in particular pedaling type devices, it has come as a surprise that no one has effectively designed a device which may be easily operated from a standing position. The standing position provides a greater overall lower body workout than other pedaling type devices.

SUMMARY AND OBJECTS OF THE INVENTION

It is the object of this invention to provide a pedaling device which is comfortable and easy to operate while in an upright position. One version allows for manual operation of the device, with rotary motion in the foot engaging assembly of the device being induced by the user. A second version of the device allows for automatic operatrion of the device whereby the rotary motion is induced by a motor. Both of these features will allow a more complete lower body workout afforded by more convention lower body exercise devices.

It is the further object of this invention to provide an upright stationary exercise device which is adjustable to different user heigths and/or arm lengths, stance widths, and overall leg motion. It is also an object of this invention to provide a device which is collapseable into a more compact configuration, and may have the necessary wheel attachments for easy relocation and/or storage.

In addition, the invention may contain an upper body workout means operating in conjunction with the lower body exercise device. This would greatly increase the capabilities of the apparatus.

Briefly stated, the apparatus that forms the basis of the present invention comprises basically a frame structure means and a foot engagement means. In one version of the device, a resistance means operates in conjunction with the foot engagement means, whereby rotary motion in the foot engagement means is manual induced by the user. The resistant means may be adjustable to vary the resistance to motion of the foot engagement means. A second version contains a motor means instead of the resistance means, whereby rotary motion in the foot engagement means is automatically induced by the motor. Both of these versions may also contain an upper body workout means which operates in conjunction with the foot enagement means.

The frame structure means includes a frame base upon which the foot engagement means mounts. Also part of the base may be an upwardly extending handle member in which the user holds onto while operating the foot engagement means. It assist the user in maintaining better balance. A foot engagement means is also a basic part of the exercise device. The design of the foot engagement means is such that the foot engaging members upon which the user places their feet always remains in a substantially horizontal position as the members move along their path of rotation. This feature is not found in other pedaling devices. The ability of the foot engaging members to maintain a substantailly horizontal position is due to a rotational translating means which will be described later on.

As mentioned previously, a resistance means may also operate in conjunction with the foot engagement means so that a resistance to motion may be applied to the foot engaging members. This would be utilized during manual operation of the apparatus by the user, with the amount of resistance being adjustable. Instead of a resistance means, a motor means may be used for automatic device operation, with motion in the foot engaging members being induced by the motor, not the user.

The apparatus may be configurable for different operating capabilities, with the frame being adjustable for different user heigths and arm lengths. Also the foot engaging members may be adjustable so that different paths of rotations may be used, and the user may vary their stance width.

The apparatus may also be collapseable into a more compact configuration by repositioning the handle member to reduce overall device heigth. Also included on the frame structure may be a wheel assembly on at least one end of the device, so that the opposite end may be uplifted and the entire device reloated to a new area.

An upper body workout means may also be part of the apparatus, which operates in conjunction with the foot engagement means. The upper body workout means comprises two hand engaging members, which move in opposite forward and backward directions as the foot engaging members move along their path of rotation. This type of upper body workout means is currently found on many other exercise devices.

Also, a typical exercise computer may also be part of the apparatus. It is not shown in the accompanying figures, but may connect to the foot engagement means and keep track of related exercise data, such as speed, distance, time, calories, etc.

Other objects, features, and advantages for this invention will be apparent from the following detailed description and the appended claims, references being made to the accompanying drawings forming a part of the apecification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description, and not limitation.

Figure 1A:
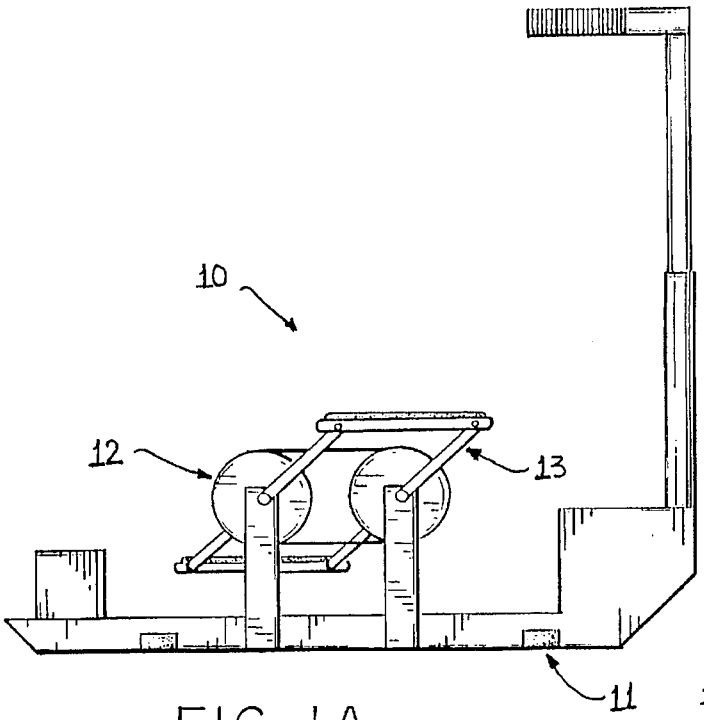
FIG. 1A is a side view of the stationary exercise apparatus.
Figure 1C:
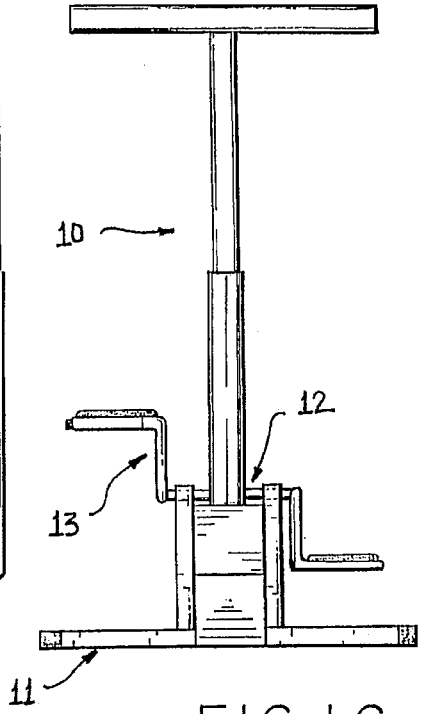
FIG. 1C is a front view of the stationary exercise apparatus.
Figure 1B:
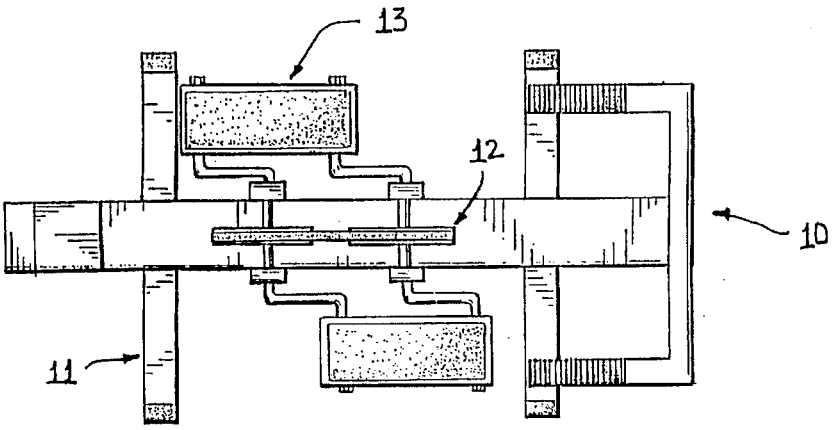
FIG. 1B is a top view of the stationary exercise apparatus.

As best can be seen by references to the drawings, and in particular to FIGS. 1A thru 1C, the stationary exercise apparatus that forms the basis of the present invention is designated generally by the reference numeral 10. Stationary exercise apparatus 10 basically comprises a frame structure means 11 and a foot engagement means 12.

Figure 1D:
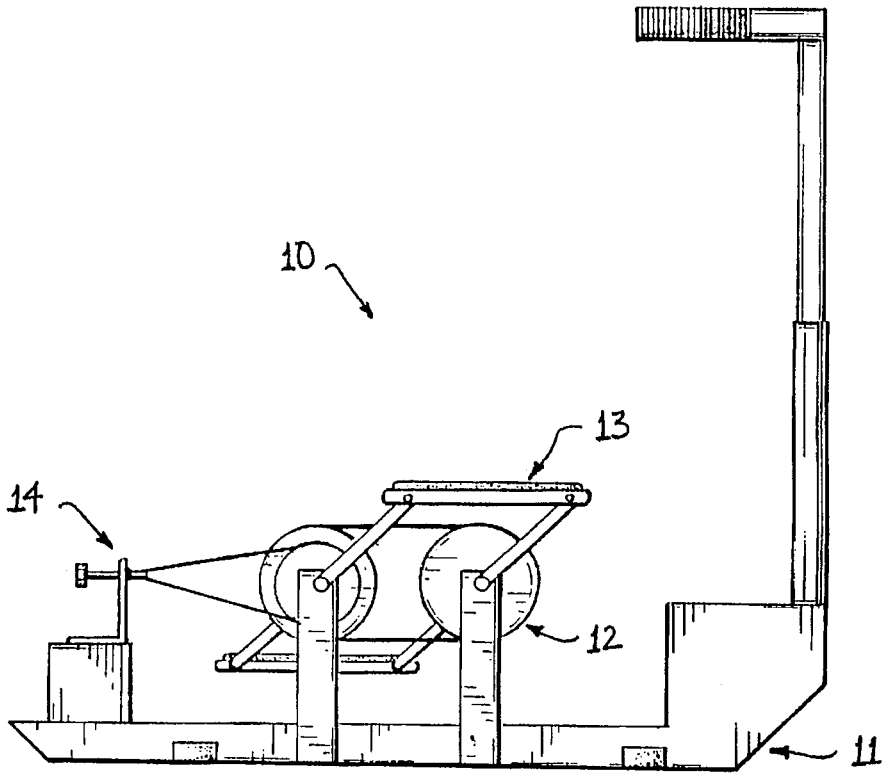
FIG. 1D is a side view of the apparatus utilizing a resistance means.
Figure 1E:
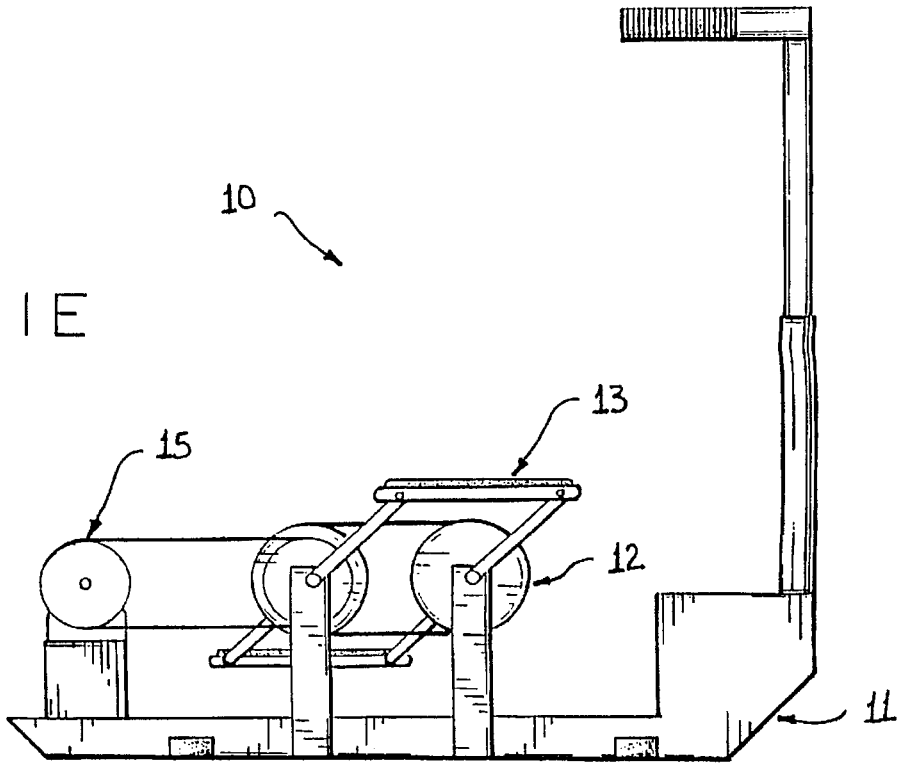
FIG. 1E is a side view of the apparatus utilizing a motor means.

As further shown in FIGS. 1D and 1E, a resistance means 14 and a motor means 15 may be utilized by the apparatus. The resistance means 14 may be used to provide a resistance to rotation in the foot engagement means during manual operation. The motor means 15 may be used to induce rotation in the foot engagement means. This for automatic device operation. Both of these features will be described in detail later on in the specification.

Figure 2A:
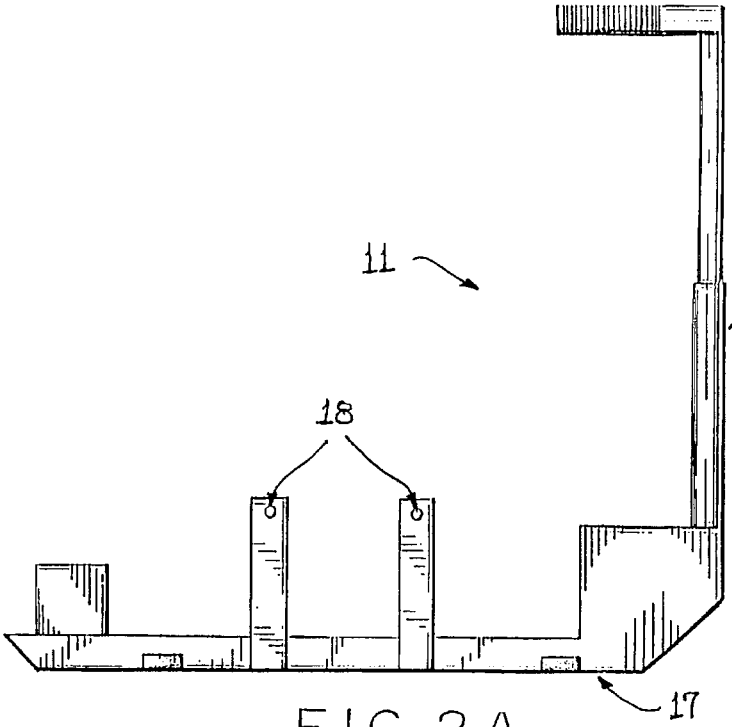
FIG. 2A is a side view of the frame structure means.
Figure 2C:
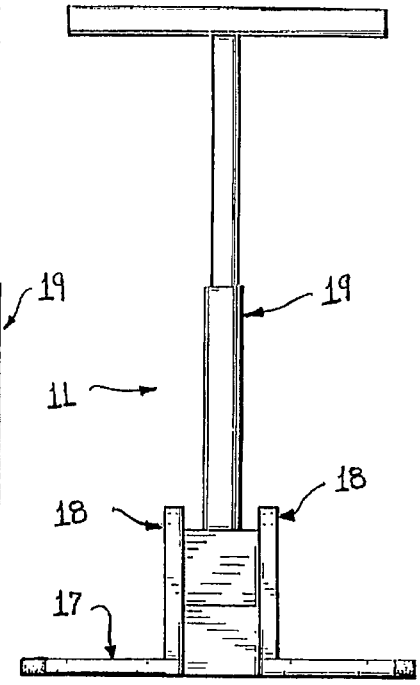
FIG. 2C is a front view of the frame structure means.
Figure 2B:
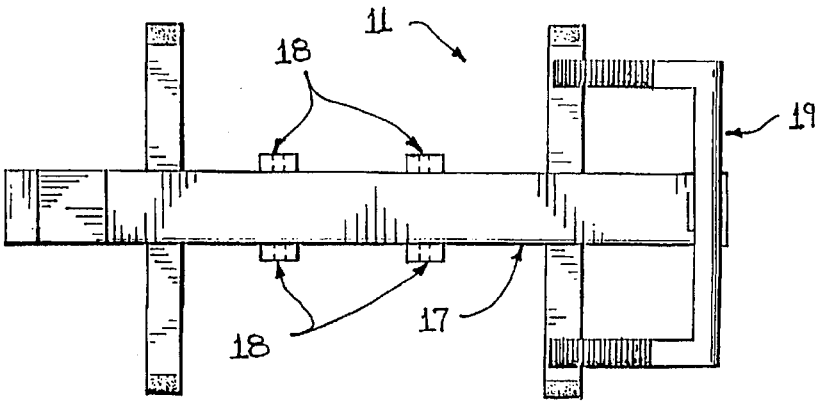
FIG. 2B is a top view of the frame structure means.
Figure 2D:
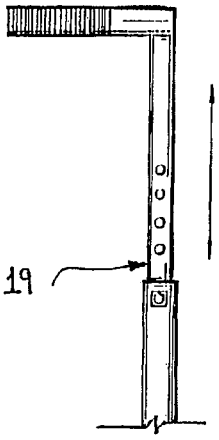
FIG. 2D is a side view of the frame structure means demonstrating an adjustable handle member for different user heigths.
Figure 2E:
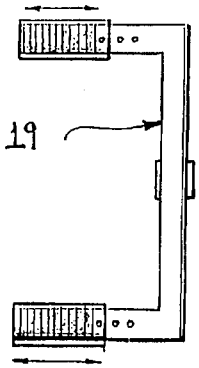
FIG. 2E is a side view of the frame structure means demonstrating an adjustable handle member for different user arm lengths.

Referring to FIGS. 2A, 2B, and 2C, frame structure means 11 comprises a base structure 17 having structure openings 18 used to mount the foot engagement means 12. A handle member 19 may also be part of the frame structure means 11 and assist the user in maintaining proper balance. As shown in FIGS. 2D and 2E, the handle member 19 may be adjustable for different user heigths and arm lengths. The base structure 17 is also used to support resistance means 14 and motor means 15.

Figure 3A:
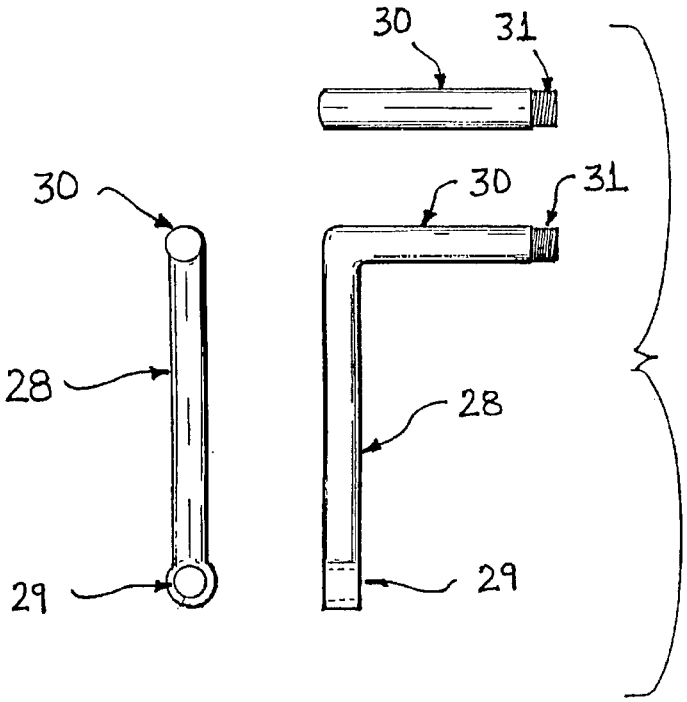
FIG. 3A is a side view of the foot engagement means.
Figure 3B:
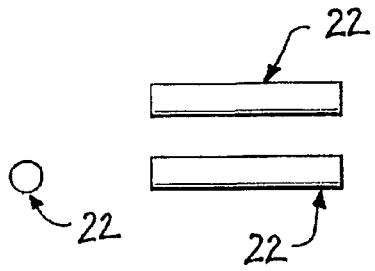
FIG. 3B is a top view of the foot engagement means.
Figure 3C:
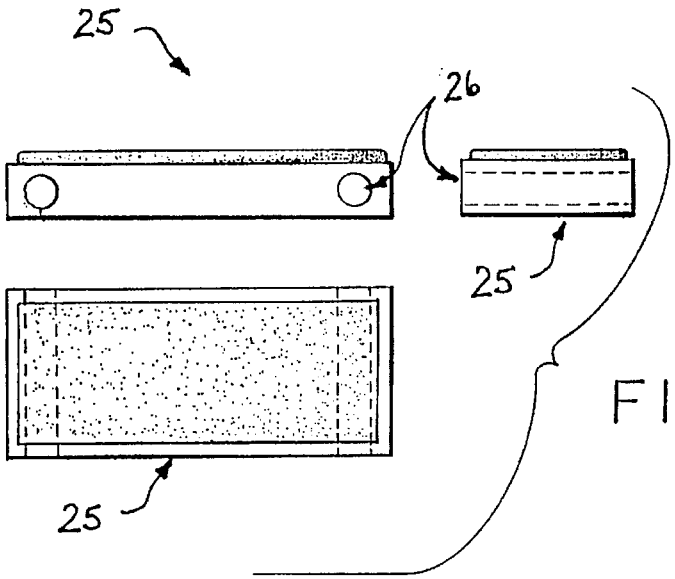
FIG. 3C is a front view of the foot engagement means.

As may be seen in FIGS. 3A thru 3C, foot engagement means 12 comprises a foot engaging members 25, connection members 27, and shaft members 22. Connection member 27 is a generally L-shaped rod element having a first leg 28 and a second leg 30. The angle between the two legs is preferred to be 90 degrees, but does not have to be. At the end of first, leg 28 is shaft opening 29, which receives shaft member 22, and is fixedly coupled together through a bolt, weld, or the like. Therefore shaft member 22 and connection member 27 rotate simultaneously. Foot engaging member 25 is a relatively flat structure upon which the user places their foot. It contains tubular opening 26 through the side which loosely receives the second leg 30 of connection member 27. Second leg 30 has a threaded end so bolt nut member 32 may be attached to keep foot engaging member in position. It is desireable for each foot engaging member 25 to be supported by at least two connection members 27.

Figure 3D:
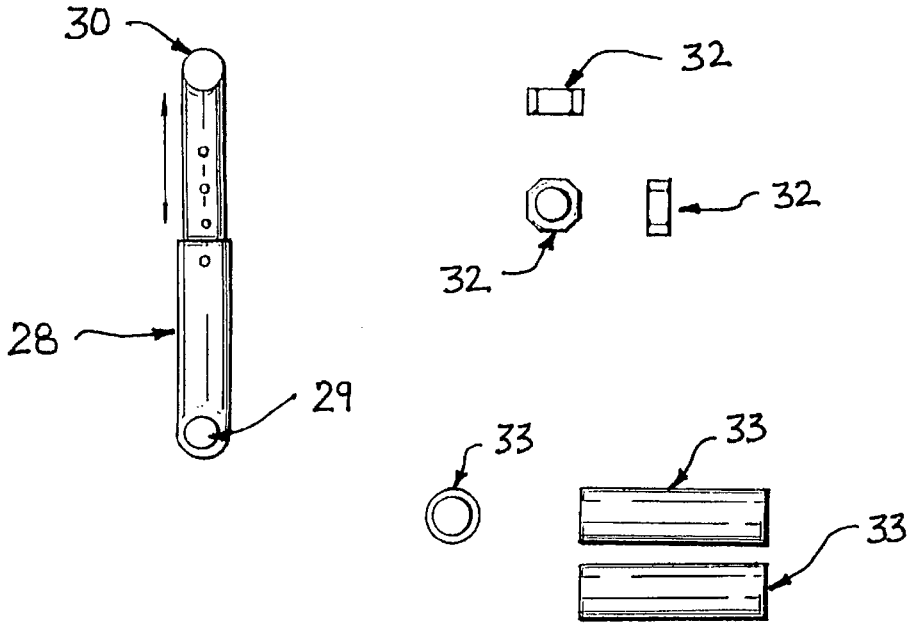
FIG. 3D is a side view of the foot engagement means demonstrating a feature for adjusting the foot engaging member path of rotation.
Figure 3E:
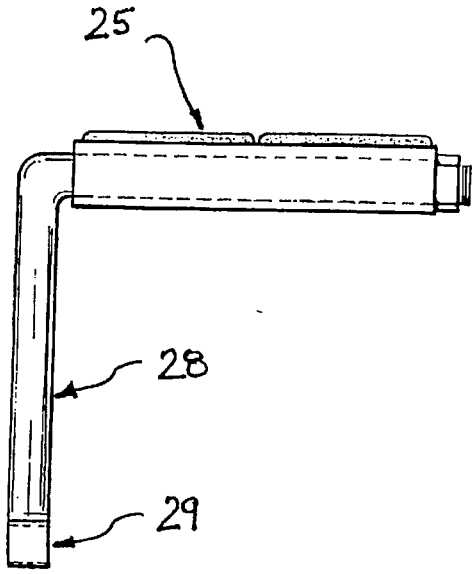
FIGS. 3E and 3F each show a side view of the foot engagement means demonstrating a feature for allowing a variable user stance.
Figure 3F:
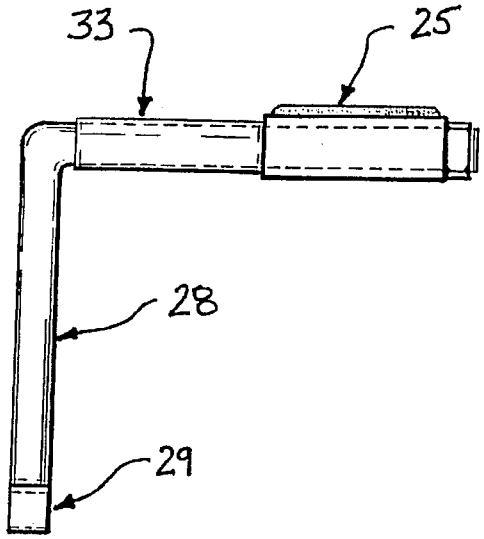

As seen in FIG. 3D, the first leg 28 may have an adjustability feature to increase and/or decrease the leg length. Shown is a typical telescoping feature in which the overall length of first leg 28 may be altered and secured through a securing means such as a pin or bolt. This feature allows for the adjustment of the path of rotation for the foot engaging member. FIGS. 3E and 3F demonstrate the ability of the user to position themselves at different widths of stance. FIG. 3E shows the second leg 30 of connection member 27 being long enough to support a foot engaging member 25 which is wide enough to support different foot positions. FIG. 3F shows a foot engaging member 25 used with a spacer 33 to position foot engaging member 25 at different positions along second leg 30. The spacer may be placed on the inside or outside of foot engaging member 25.

Figure 4A:
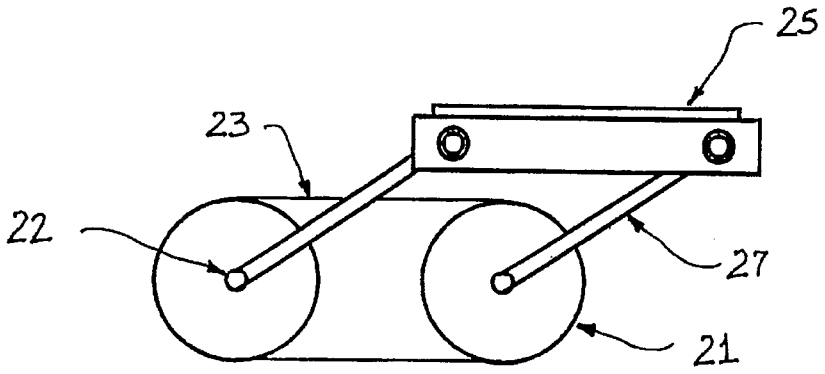
FIG. 4A is a side view of the foot engagement means showing one type of rotational translating means.
Figure 4B:
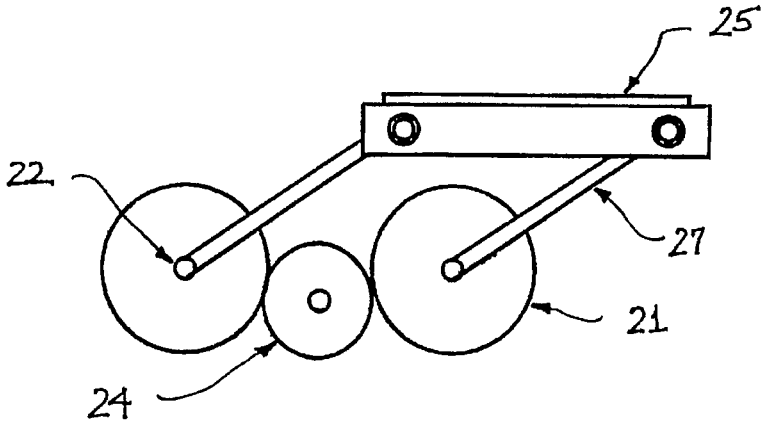
FIG. 4B is a side view of the foot engagement means showing a second type of rotational translating means.
Figure 4C:
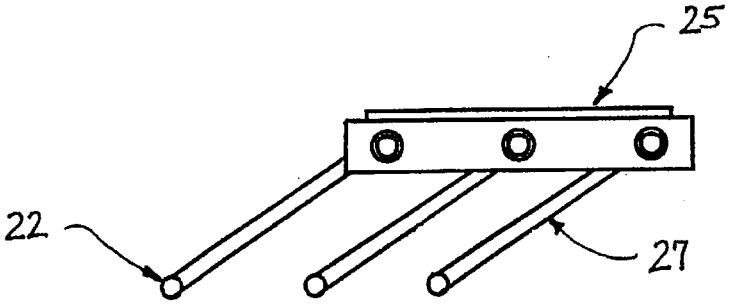
FIG. 4C is a side view of the foot engagement means showing a third type of rotational translating means.

Shown in FIGS. 4A, 4B, and 4C are three different types of rotational translating means, which are used to keep foot engaging members 25 at substantially horizontal positions as they move along their path of rotation. In order to achieve this, shaft members 22 of foot engagement means 12 must rotate in the same direction and at the same angular velocity and acceleration.

FIG. 4A shows rotatable members members 21 which fixedly mount on shaft members 22. Rotatable members 21 are connected together by a closed loop interconnection member 23. The interconnection member 23 keeps rotatable members 21 rotating in the same direction and at the same angular velocity and acceleration, therefore allowing shaft member 22 to do the same. This is a typical drive train setup, such as sprockets and chains, pulleys and belts, gears and drive shafts, etc.

FIG. 4B demonstrates a second type of rotational translating means. In this instance, there are again rotatable members 21 which fixedly mount on shaft members 22. An intermediate rotatable member 24 mounts similarly on base structure 17, and is in rotating contact with rotatable members 21. This intermediate rotatable member 21 keeps rotatable members 21 rotating in the same direction and at the same angualr velocity and acceleration. This is a typical gear type assembly means, such as rotating gears with interfacing teeth or roller members with enough friction between surfaces so that no slippage occurs.

FIG. 4C demonstartes a third type of rotational translating means.

In this version, an additional shaft member 22 and conneciton member 27 is added to the foot engaging member 25. These additional components keep foot engaging member 25 at a substantially horizontal position, and shaft members 22 rotating in the same direction and at the same angular velocity and acceleration. Many variations of the above rotational translating means exist and the configurations listed are intended for demonstration purposes only.

Figure 5:
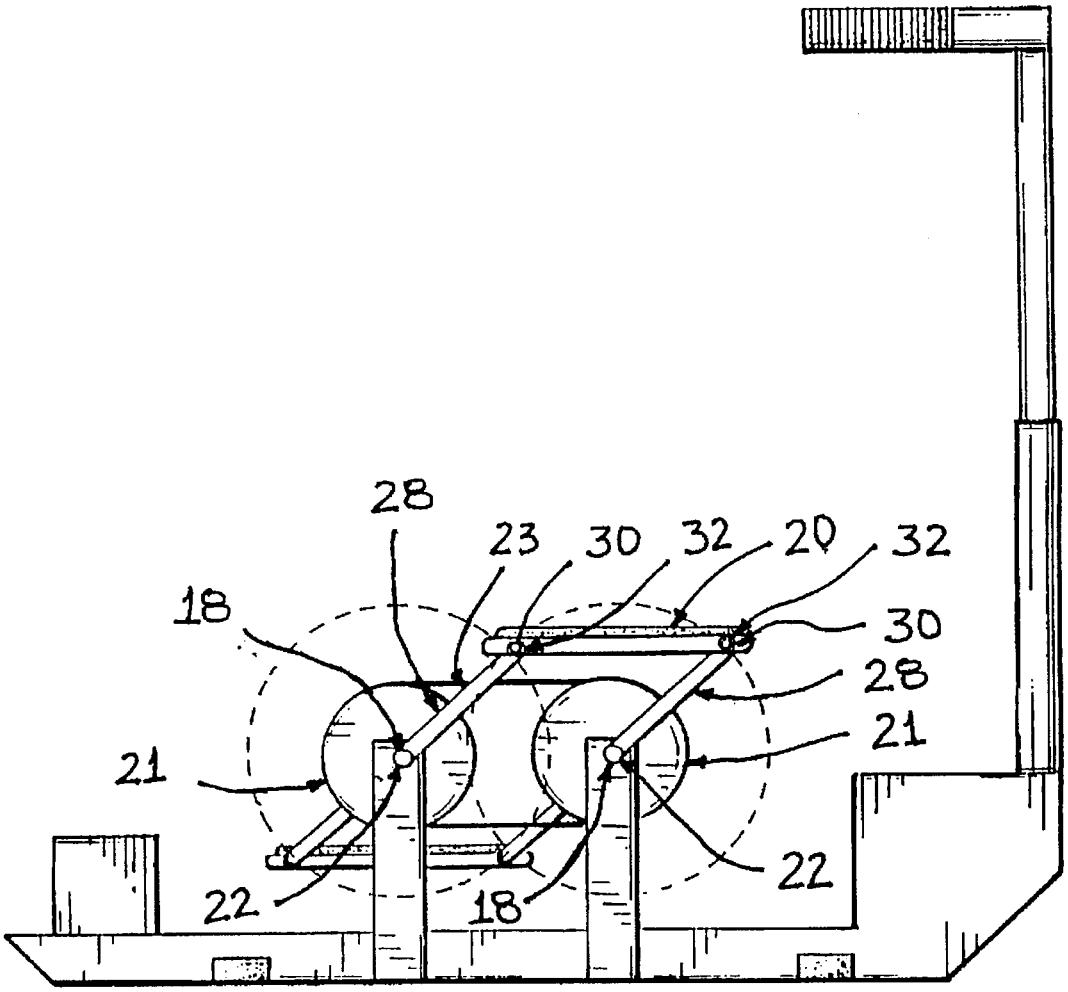
FIG. 5 is a side view of the foot engagement means as it mounts on the frame structure means, demonstrating the path of rotation followed by the foot engaging members during device operation.

FIG. 5, along with the previous figures, demonstrates how frame structure means 11 and foot engagement means 12 operate in conjunction with one another. As seen, at least two shaft members 22 are rotatably coupled to base structure 17 through structure openings 18. Fixedly attached to the end of each shaft member 22 are connection members 27, at least two per side. The connection members on one side of the device are mounted at the same angle, while those on the opposite side are mounted at opposite angles to the previous ones. Each foot engaging member 25 loosely receives the second legs 30 of at least two connection members 27.

Since the connection members 27 are identical in lengths and shaft members 22 are mounted on base structure 17 at the same level, the foot engaging member 25 will be in a substantially horizontal position and remain so as long as shaft members 22 rotate in the same direction and at the same angular velocity and acceleration. This is ensured by the rotational translating means 13. FIG. 5 demonstrates a rotational translating means comprising two rotatable members 21 and a closed loop interconnection member 23.

As seen, foot engaging members 25 will rotate in a curved path when force is applied to the members by the feet of the user during manual operation of the apparatus or motion is induced in shaft members 22 by a motor means during automatic operation. Movement of the foot engaging members 25 will be along the same path but will be in opposite directions due to the opposite mounting of connection members 27 with respect to each side. The foot engaging members 25 may have the capability to rotate in the forward or reverse direction, which would make the apparatus even more flexible.

Figure 6A:
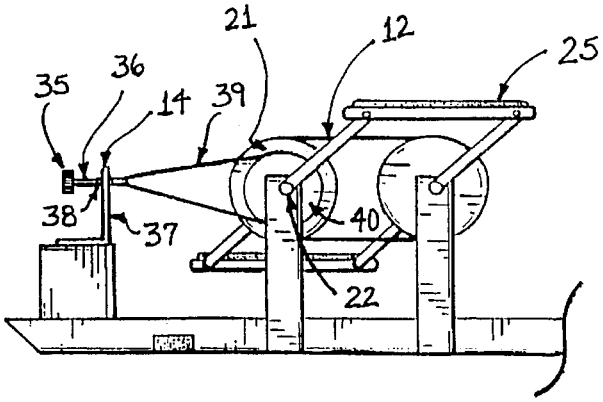
FIG. 6A is a side view of a resistance means operating in conjunction with the foot engagement means.
Figure 6C:
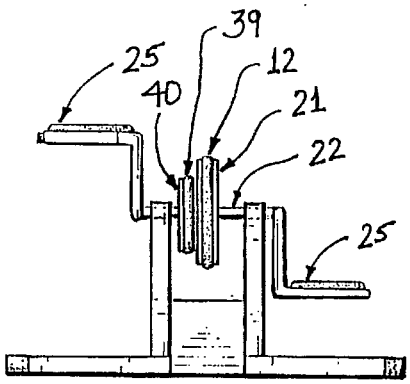
FIG. 6C is a front view of a resistance means operating in conjunction with the foot engagement means.
Figure 6B:
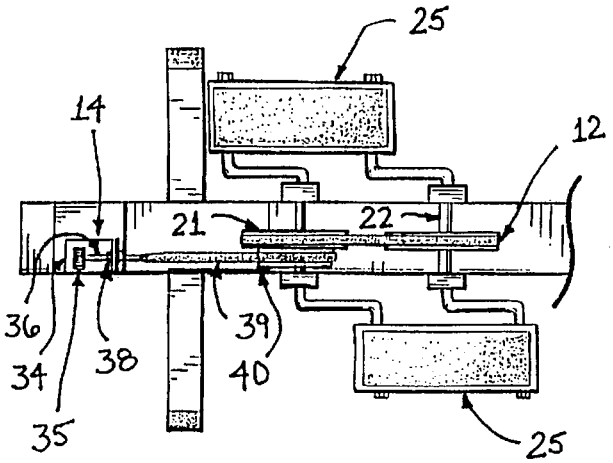
FIG. 6B is a top view of a resistance means operating in conjunction with the foot engagement means.

As may be seen in FIGS. 6A, 6B, and 6C, a resistance means 14 may be utilized by the foot engagement means 12 to provide a resistance to motion in foot engagement members 25. Many different types of resistance means currently exist which may be utilized by this apparatus. It is to be understood that the resisatance means 14 specified in the application is for demonstration purposes only.

The resistance means 14 in this specification is a commonly known device which consists of an endless friction belt 39 which extends around at least a portion of the periphery of circular member 40. The circular member 40 is fixedly mounted on one of the shaft members 22, so that when shaft member 22 rotates, so will this circular member 40. The tension on friction belt 39 is adjusted by tension adjustment means 34, which consist of a threaded shaft 36 and hand operated knob 35. The threaded shaft 36 of tension adjsutment means 34 mounts through a threaded opening 38 of tension mount 37. The friction belt 39 loosely connects to threaded shaft 36 so that turning hand operated knob 35 does not cause friction belt 39 to twist, and the belt will not rotate as circular member 40 rotates. When the hand operated knob 35 is turned in one direction, threaded shaft 36 will turn accordingly and move backward, causing friction belt 39 to tighten against circular member 40. Upon turning the knob in the opposite direction, the belt will loosen. The force exerted by the friction belt 22 against circular member produces a resistance to motion in circular member 40, shaft member 22, and therefore foot engaging member 25. The amount of force may be varied by the tension adjustment means 34.

Figure 7A:
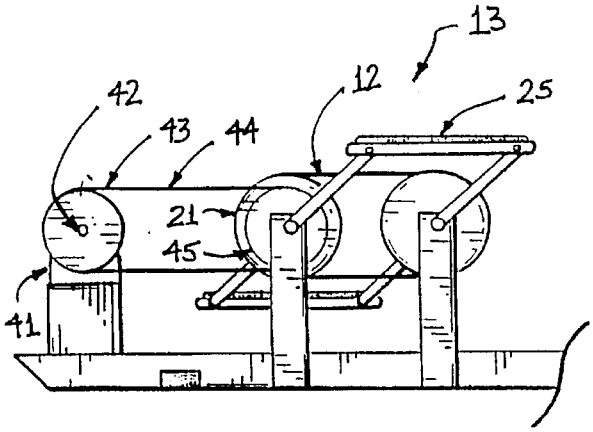
FIG. 7A is a side view of a motor means operating in conjunction with the foot engagement means.
Figure 7C:
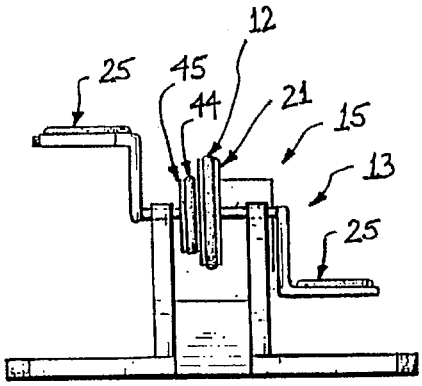
FIG. 7C is a front view of a motor means operating in conjunction with the foot engagement means.
Figure 7B:
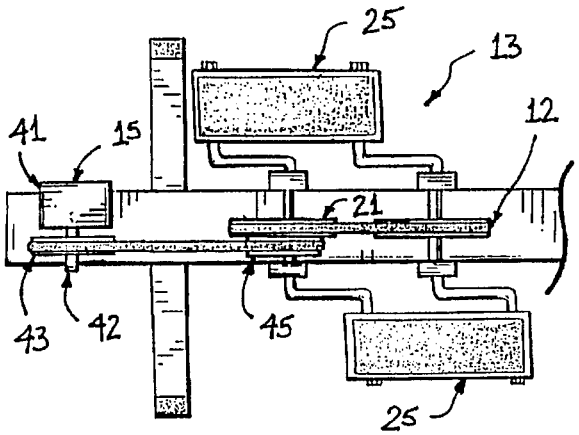
FIG. 7B is a top view of a motor means operating in conjunction with the foot engagement means.

FIGS. 7A thru 7C demonstrate a typical motor means 15 which may be utilized by foot engagement means 12 for automatic operation of the apparatus. Rotation in foot engaging member 25 of foot engagement means 12 is produced by a motor, not the feet of the user. The motor means 15 comprises a motor 41 with a shaft rotatable member 43 fixedly mounted on motor shaft member 42. A motor rotatable member 45 is fixedly mounted on shaft member 22 of foot engagement means 12, with a closed loop interconnection member 44 operatively connecting shaft rotatable member 43 and motor rotatable member 45. As the motor shaft turns, so will shaft rotatable member 43 and motor rotatable member 45. Since motor rotatable member 45 is fixedly mounted on shaft member 22, shaft member 22 will rotate accordingly, thereby causing foot engaging members 25 to move along their path of rotation. Again, many variation of this assembly may exist, the simplest of which would be a chain and sprocket assembly. The assembly above is intended for demonstration purposes.

Figure 8A:
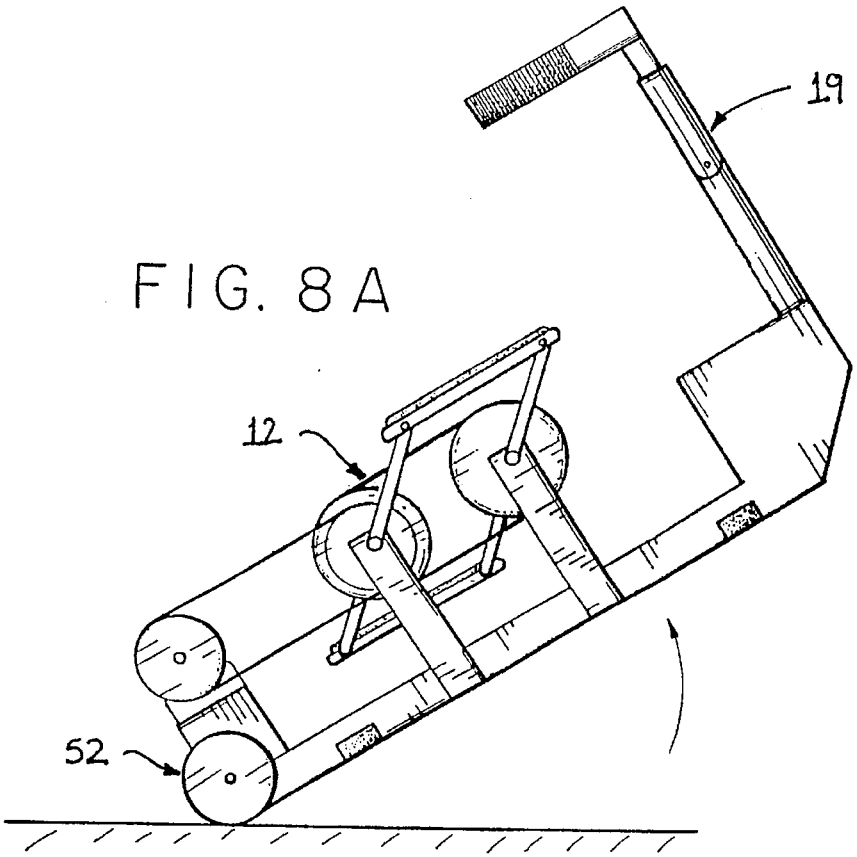
FIG. 8A is a side view of the apparatus demonstrating a collapseable handle member and wheel attachments for easy transport and storage.
Figure 8B:
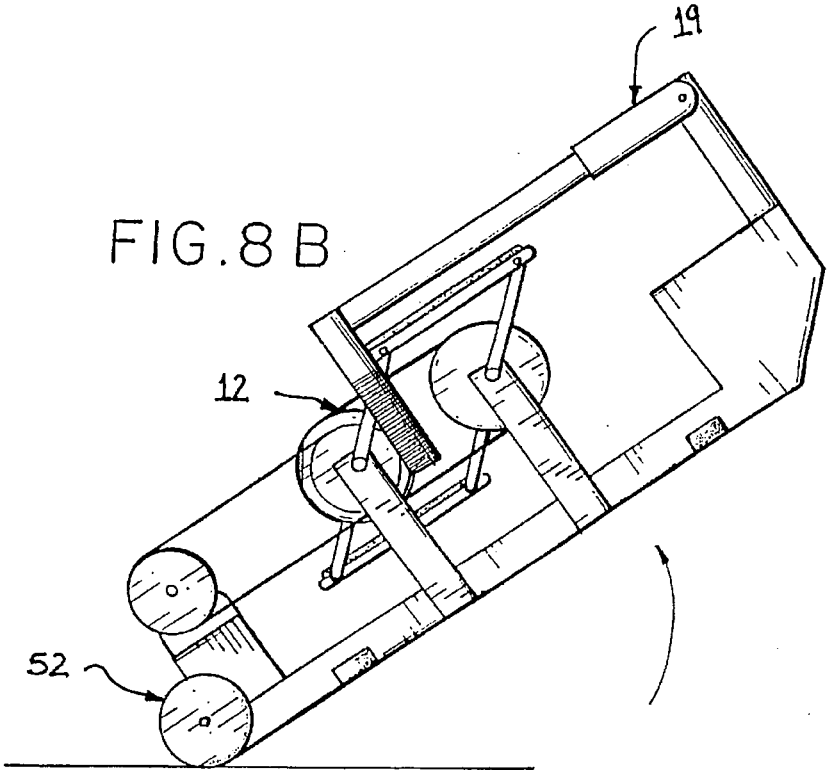
FIG. 8B is a side view of the apparatus demonstrating a different type of collapseable handle member and wheel attachments for easy transport and storage.
Figure 9A:
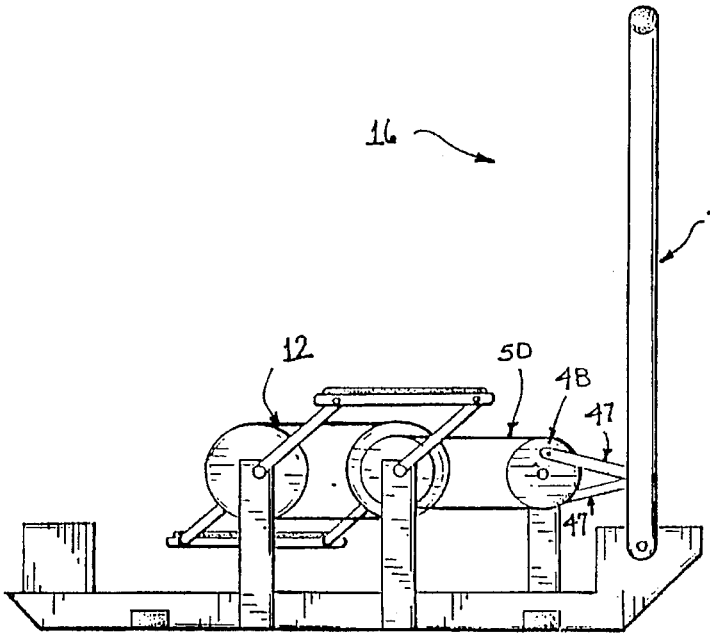
FIG. 9A is a side view of the apparatus with an upper body workout means operating in conjunction with the foot engagement means.
Figure 9C:
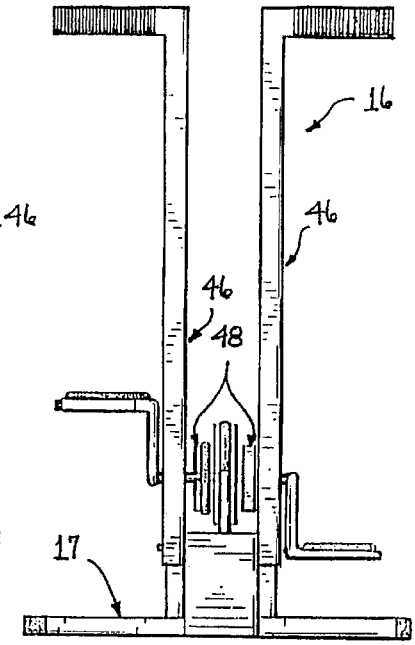
FIG. 9C is a front view of the apparatus with an upper body workout means operating in conjunction with the foot engagement means.
Figure 9B:
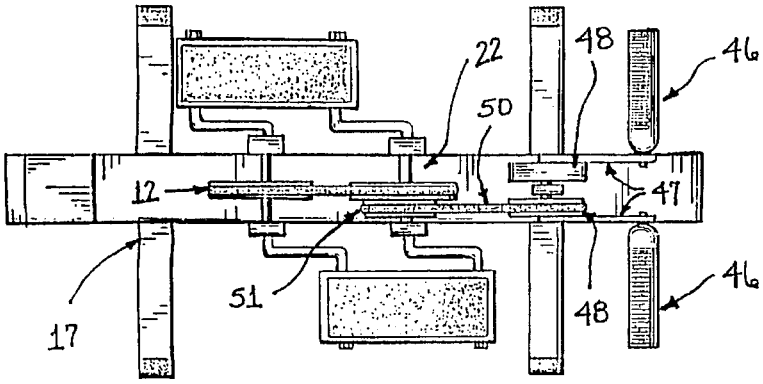
FIG. 9B is a top view of the apparatus with an upper body workout means operating in conjunction with the foot engagement means.
Figure 9D:
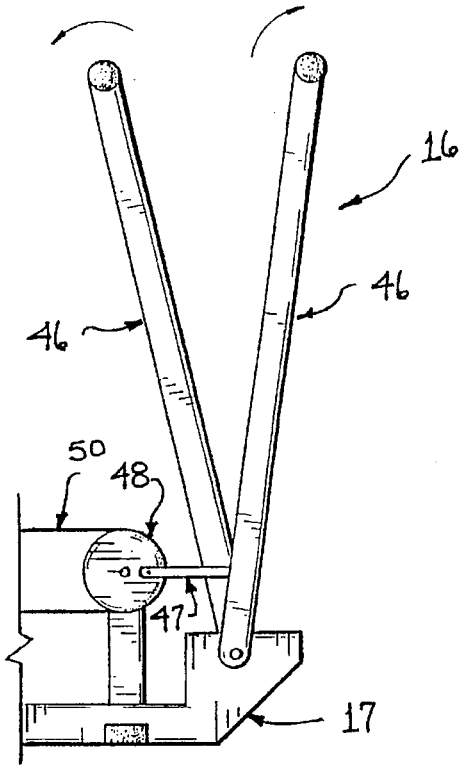
FIGS. 9D and 9E each show a side view of the upper body workout means demonstrating the back and forth rocking motion of the hand engagement means.
Figure 9E:
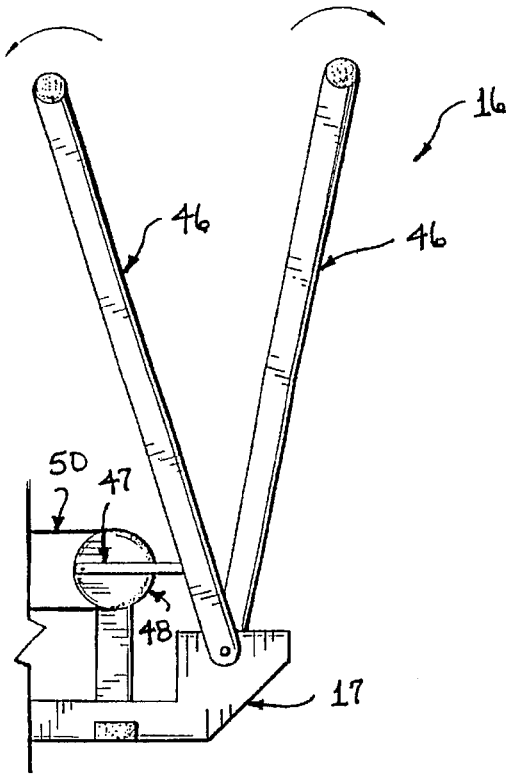

As may be seen in FIGS. 8A and 8B, frame strcuture means 11 may be collapsed into a more compact configuration for easier storage and relocation. In FIG. 8A, handle member 19, may be substantially lowered through a typical telescoping feature to reduce the overall heigth of the apparatus. FIG. 8B shows a handle member 19 which may be folded over, which also reduces overall heigth of apparatus.

A handle member may be designed which incorporates both lowering abilities.

Also shown is a typical wheel assembly 52 mounted on base structure 17. This assembly is a basic wheel and axle assembly, mounted on at least one end of apparatus so that the opposite end may be uplifted and the device rolled to a new location.

FIGS. 9A thru 9E demonstrate an upper body workout means 16 which may operate in conjunction with foot engagement means 12. Upper body workout means is an assembly which is commonly used in many treadmills, stair-stepper, and cycling devices. It consist of two hand engageable members 46 which are rotatably coupled to base structure 17. Both hand engageable members 46 are connected to motion transfer rotatable members 48, one to each, by coupling members 47. The connection is such that rotation in motion transfer rotatable member 48 will cause a bakward and forward rocking motion in the hand engageable members 46, the motion in each being opposite the other.

Motion transfer rotatable members 48 are rotatably mounted to base structure 17 and will rotate at the same direction and same angular velocity and acceleration. An assembly rotatable member 51 is fixedly mounted on a shaft member 22 of foot engagement means 12. A closed loop interconnection means 50 operatively connects assembly rotatable member 51 and at least one motion transfer rotatable member 48, so that rotation in one produces rotation in the other. Therefore, the foot engaging members 25 of foot engagement means 12 will move along their path of rotation due either through manual foot operation or automatic motor operation as discussed earlier, or through the user pushing and pulling back on the hand engageable members 46 with their hands.

The hand engageable members 46 may also be adjustable for different user heigths and for different grasping widths. The members may also have a typical telescoping feature so that they may be adjusted upward and downward. Also, the grasping part of hand engaging members 46 may have a telescoping feature which lets the user adjust how wide a grasp is desired. The hand engageable members 46 may also be collapseable into a more compact form by disconnecting the members from the motion transfer rotatable members and folding the hand engaging member or a collapseable feature similar to that for handle member 19 shown in FIGS. 8A and 8B. Also included may be a similar wheel assembly for easier relocation.

The apparatus comprises basically a structure frame means and a foot engagement means. The additional means include a resistance means, motor means, and upper body workout means, which may be added singularly or in some combination with one another.

While it will be apparent that the preferred embodiment of the invention herein disclosed is well-calculated to fulfill the objects above stated, it will be appreciated that the invention is susceptible to modification, variation, and change without departing from the proper scope or fair meaning of the subjoined claims.

I claim:

1. A stationary exercise apparatus comprising:

a frame structure;

a rotation assembly mounted on said frame structure, wherein said rotation assembly includes at least two rotatable members, said rotatable members being operatively connected by a connection means such that said rotatable members rotate at generally the same angular velocity and acceleration;

foot engagement means connected to said rotation assembly wherein said foot engagement means includes connection members and two foot engaging members, each of said foot engaging members being connected to one side of each of said rotatable members through said connection members such that both foot engaging members remain in a substantially horizontal position as the rotatable members rotate, said foot engaging members and said connection members being attached along horizontal axes restricting relative movement to rotation about said axes;

wherein each foot engaging member comprises a substantially flat top surface and sleeve openings spaced along the side to receive said connection members, each of said connection members is a substantially L-shaped structure having a first and second leg, said first keg including means for rigid attachment to one of said rotatable members, and said second leg including means for attachment with one degree of freedom to one of said foot engaging members;

whereby a user may perform a cycling routine while in a standing position.

2. A stationary exercise apparatus according to claim 1, wherein said frame structure includes a handle member.

3. A stationary exercise apparatus according to claim 1, wherein said handle member is upward and downward adjustable.

4. A stationary exercise apparatus according to claim 1, wherein said rotatable members and said connection means together comprise a sprockets and chain assembly.

5. A stationary exercise apparatus according to claim 1, wherein said rotatable members and said connection means together comprise a gear assembly.

6. The stationary exercise apparatus as claimed in claim 1, said foot engagement means further comprising shaft members used to rigidly connect said connection members to said rotatable members.

7. A foot engagement means as claimed in claim 1, said first leg of said connection member being adjustable to different lengths.

8. A foot engagement means as claimed in claim 1, said foot engaging member being positionable upon said second leg of said connection member whereby the user may vary their width of stance.

9. A stationary exercise apparatus as claimed in claim 6, said apparatus further comprising a resistance means operatively connected to said foot engagement means to provide motion resistance in said foot engaging members of said foot engagement means as they move along their path of rotation.

10. A stationary exercise apparatus as claimed in claim 9, said resistance means comprising;

at least one circular member fixedly mounted on said shaft member of said foot engagement means, said circular member rotating in conjunction with said shaft member;

an endless friction belt which loops around at least a part of the periphery of said circular member;

a tension adjustment means mounted on said base structure and connected to said friction belt whereby forces may be exerted by said friction belt upon said circular member, thereby producing a motion resistance in said circular member, said shaft member, and therefore said foot engaging member.

11. A resistance means as claimed in claim 10, said tension adjustment means comprising;

a hand operated knob;

a threaded shaft fixedly connected to said hand operated knob and connected to said friction belt;

a tension mount fixedly mounted on said base structure and containing a threaded opening which turnably receives said threaded shaft, whereby turning said hand operated knob in one direction tightens the belt against said circular member, thereby allowing the user to vary the amount of motion resistance against the user.

12. A stationary exercise apparatus as claimed in claim 6, further comprising a motor means used to induce motion in said foot engagement means.

13. A stationary exercise apparatus as in claim 12, said motor means comprising;

a motor having a motor shaft;

a shaft rotatable member fixedly mounted on said motor shaft;

a motor rotatable member fixedly mounted on said shaft member of said foot engagement means;

a connection means for connecting shaft rotatable member and motor rotatable member, so that motor operation produces rotation in said shaft rotatable member, motor member, said shaft member of said foot engagement means, and therefore said foot engaging member of said foot engagement means.

14. A motor means as claimed in claim 13, said shaft rotatable member, motor rotatable member, and interconnection means being a chain and sprocket assembly.

* * * * *